US011813670B2

(12) United States Patent
Motohashi et al.

(10) Patent No.: US 11,813,670 B2
(45) Date of Patent: Nov. 14, 2023

(54) CASTING METHOD, AND CASTING DEVICE

(71) Applicant: HONDA FOUNDRY CO., LTD., Kawagoe (JP)

(72) Inventors: Naohisa Motohashi, Kawagoe (JP); Yoshikazu Atsuzawa, Kawagoe (JP); Ayumu Teduka, Kawagoe (JP); Yasuyuki Ito, Kawagoe (JP)

(73) Assignee: Honda Foundry Co., Ltd., Saitama (JP)

( * ) Notice: Subject to any disclaimer, the term of this patent is extended or adjusted under 35 U.S.C. 154(b) by 0 days.

(21) Appl. No.: 17/770,773

(22) PCT Filed: Oct. 26, 2020

(86) PCT No.: PCT/JP2020/040034
§ 371 (c)(1),
(2) Date: Apr. 21, 2022

(87) PCT Pub. No.: WO2021/131293
PCT Pub. Date: Jul. 1, 2021

(65) Prior Publication Data

US 2022/0362842 A1 Nov. 17, 2022

(30) Foreign Application Priority Data

Dec. 23, 2019 (JP) ..... 2019-231944

(51) Int. Cl.

| | |
|---|---|
| ***B22D 37/00*** | (2006.01) |
| ***B22D 18/06*** | (2006.01) |
| ***B22C 9/08*** | (2006.01) |
| ***B22D 7/00*** | (2006.01) |

(52) U.S. Cl.
CPC ..... *B22D 7/00* (2013.01); *B22C 9/082* (2013.01); *B22D 18/06* (2013.01)

(58) Field of Classification Search
CPC ..... B22C 9/08; B22C 9/082; B22D 18/04; B22D 18/06; B22D 37/00
USPC ..... 164/113, 119, 133, 284, 337
See application file for complete search history.

(56) References Cited

U.S. PATENT DOCUMENTS 6,189,600 B1 2/2001 Taniguchi et al.

FOREIGN PATENT DOCUMENTS

| | | | |
|---|---|---|---|
| CN | 108311673 | A | 7/2018 |
| JP | H10-296424 | A | 11/1998 |
| JP | 2009-195970 | A | 9/2009 |
| JP | 2014-104469 | A | 6/2014 |
| JP | 2016-043356 | A | 4/2016 |

(Continued)

OTHER PUBLICATIONS

Machine translation of WO 2016/135843 A1 (Year: 2016).*

*Primary Examiner* — Kevin P Kerns
(74) *Attorney, Agent, or Firm* — Carrier, Shende & Associated P.C.; Joseph P. Carrier; Fulchand P. Shende

(57) ABSTRACT

According to a casting method, a molten metal is sustained at a sustain position between a casting and the next casting, and the molten metal flow is divided from one pouring gate (44) to a plurality of sprue runners (46 and 47) in the casting. The sprue runners (46 and 47) are branched by a V-shaped portion (45) in a V-shape, and the sustain position of the molten metal is set above (any one of P1, P2 and P4) the V-shaped portion (45). The V-shaped portion (45) is filled with the molten metal while a repeated casting is carried out.

5 Claims, 7 Drawing Sheets

(56) References Cited

FOREIGN PATENT DOCUMENTS

| | | | | |
|---|---|---|---|---|
| JP | 2016-087657 A | 5/2016 | | |
| WO | WO 2016/135843 A1 * | 9/2016 | ..... | B22D 18/04 |

* cited by examiner

CASTING METHOD, AND CASTING DEVICE

TECHNICAL FIELD

The present disclosure relates to a casting method and a casting device.

BACKGROUND ART

A technology of obtaining a cast product by pouring a molten metal in a die and pressuring it is known (see, for example, Patent Document 1 (FIG. 1)).

Patent Document 1 will be described with reference to the following figure.

FIG. 7 is a basic structural diagram of a conventional casting device.

As illustrated in FIG. 7, a casting device 100 includes an upper die 106, a lower die 108 provided with a feed tip 107, a sleeve 111 placed so as to face the feed tip 107, a heater 112 surrounding the sleeve 111, a plunger 113 stored in the sleeve 111, a vacuum chamber 114 surrounding all of these components, and vacuum pumps 115 and 116 attached to the vacuum chamber 114.

The upper die 106 includes a first cavity 101, a second cavity 102, a first sprue runner 103, a second sprue runner 104, and a cutter 105.

The interior of the vacuum chamber 114 is depressurized by the vacuum pump 115, and the first cavity 101 and the second cavity 102 are depressurized by the vacuum pump 116.

An aluminum material is filled in the sleeve 111, and is melted by the heater 112. After the melting, the sleeve 111 is moved forward, and the tip of the sleeve 111 is caused to abut the feed tip 107. The plunger 113 is moved forward so as to push out the molten metal.

Some of the molten metal flows through the feed tip 107, the first sprue runner 103, and the first cavity 101 in this sequence.

The remaining of the molten metal flows through the feed tip 107, the second sprue runner 104, and the second cavity 102 in this sequence.

When the molten metal solidifies, the cutter 105 is moved forward (in the figure, moved downwardly) to cut the sprue-runner portion of a cast. The cut sprue-runner portion passes through the feed tip 107, falls in the sleeve 111, and is reused by the next melting.

Until the next melting, no molten metal is present around the feed tip 107. The feed tip 107 is formed of ceramics with an excellent heat insulation performance (see Patent Document 1, paragraph 0019).

The conventional casting device 100 has advantages to be described below.

Since the first cavity 101 and the second cavity 102 are depressurized, a molten metal circulating performance is enhanced. In addition, since depressurized, there is no remaining air in the first cavity 101 and in the second cavity 102, suppressing an occurrence of a cavity in a cast.

In contrast, the conventional casting device 100 has disadvantages to be described below.

First, the molten metal that has passed through the feed tip 107 collides with the cutter 105, and changes the direction by 90 degrees to the left side and the right side. Such a sudden change in the molten metal flow direction causes a difference between the left flow and the right flow. Such a difference becomes a cause of a casting defect.

Secondly, the ceramics that forms the feed tip 107 are weak against a thermal shock, which is represented by an earthen ware. Consequently, the lifetime of the feed tip 107 become relatively short. A replacement cycle of the feed tip 107 increases, resulting in a cause of a manufacturing cost increase.

Thirdly, since the vacuum chamber 114 and the vacuum pumps 115 and 116 are essential, the casting device 100 becomes expensive.

In a casting that divides a molten metal flow into a plurality of sprue runners, a casting technology that can accomplish uniform flows after the molten metal flow is divided is desired.

CITATION LIST

Patent Literatures

Patent Document 1: JP H10-296424 A

SUMMARY OF INVENTION

Technical Problem

An objective of the present disclosure is to provide a casting technology that can accomplish uniform flows after a molten metal flow is divided in a casting that divides a molten metal flow.

Solution To Problem

According to a first example embodiment, there is provide a casting method of sustaining a molten metal at a sustain position between a casting and a next casting, and of dividing a flow of the molten metal from one pouring gate to a plurality of sprue runners in the casting, in which the plurality of sprue runners is branched by a V-shaped portion formed in a V-shape, in which the sustain position of the molten metal is set above the V-shaped portion, and in which the V-shaped portion is filled with the molten metal while a repeated casting is carried out.

According to a second example embodiment, there is provided a casting device that includes:

a die;

a molten metal flow dividing block;

an electromagnetic pump that supplies a molten metal; and a control unit that controls the electromagnetic pump, in which the molten metal flow dividing block comprises one pouring gate and a plurality of sprue runners branched by a V-shaped portion formed in a V-shape, in which the electromagnetic pump is driven by an AC power supply, and in which the control unit maintains a sustain position of the molten metal above the V-shaped portion.

According to a third example embodiment, preferably, a casting device is the casting device according to the second example embodiment, in which the molten metal flow dividing block is formed of ceramics.

According to a fourth example embodiment, preferably, a casting device is the casting device according to the second example embodiment or the third example embodiment, in which the control unit maintains the sustain position of the molten metal substantially at a top surface of the molten metal flow dividing block.

Advantageous Effects of Invention

According to the first example embodiment, the V-shaped portion is filled with the molten metal.

If the molten metal collides casting by casting, a disturbance occurs, and there is a difference in the divided flows. According to the present disclosure, since the molten metal does not collide the V-shaped portion, there is no difference in the divided flows.

In addition, in comparison with a T-shaped portion, in the case of the V-shaped portion, a change in the molten metal flow direction is little, making the flows further uniform.

Hence, according to the present disclosure, there is provided a casting technology that can accomplish uniform flows after a molten metal flow is divided in a casting that divides a molten metal flow.

According to the second example embodiment, in addition to the advantageous effects of the first example embodiment, the following advantageous effects can be accomplished.

When the electromagnetic pump is driven by an AC power supply, a fine pressure change occurs in the molten metal. This pressure change disrupts the solidification of the molten metal.

That is, since the electromagnetic pump is adopted, the flowability of the molten metal is enhanced, and thus the sustain position of the molten metal can be maintained above the V-shaped portion without a temperature increase of the molten metal.

According to the third example embodiment, the molten metal flow dividing block is formed of ceramics. Ceramics have a remarkably small thermal conductivity in comparison with metal. Since the molten metal flow dividing block formed of ceramics retains heat well, the temperature decrease of the molten metal is suppressed.

According to the fourth example embodiment, the control unit maintains the sustain position of the molten metal substantially at a top surface of the molten metal flow dividing block. The V-shaped portion is filled with the molten metal. Since the molten metal does not collide with the V-shaped portion, there is no difference in the divided flows.

Moreover, although the molten metal flow dividing block formed of ceramics has an excellent heat insulation performance, it is weak against thermal shock. According to the present disclosure, since the molten metal is always caused to flow in or stored in the molten metal flow dividing block formed of ceramics, a temperature change becomes little, and thus thermal shock is suppressed. Consequently, the lifetime of the molten metal flow dividing block formed of ceramics can be remarkably extended.

DESCRIPTION OF EMBODIMENTS

Embodiments of the present disclosure will be described below with reference to the accompanying figures.

Embodiment

Figure 1:
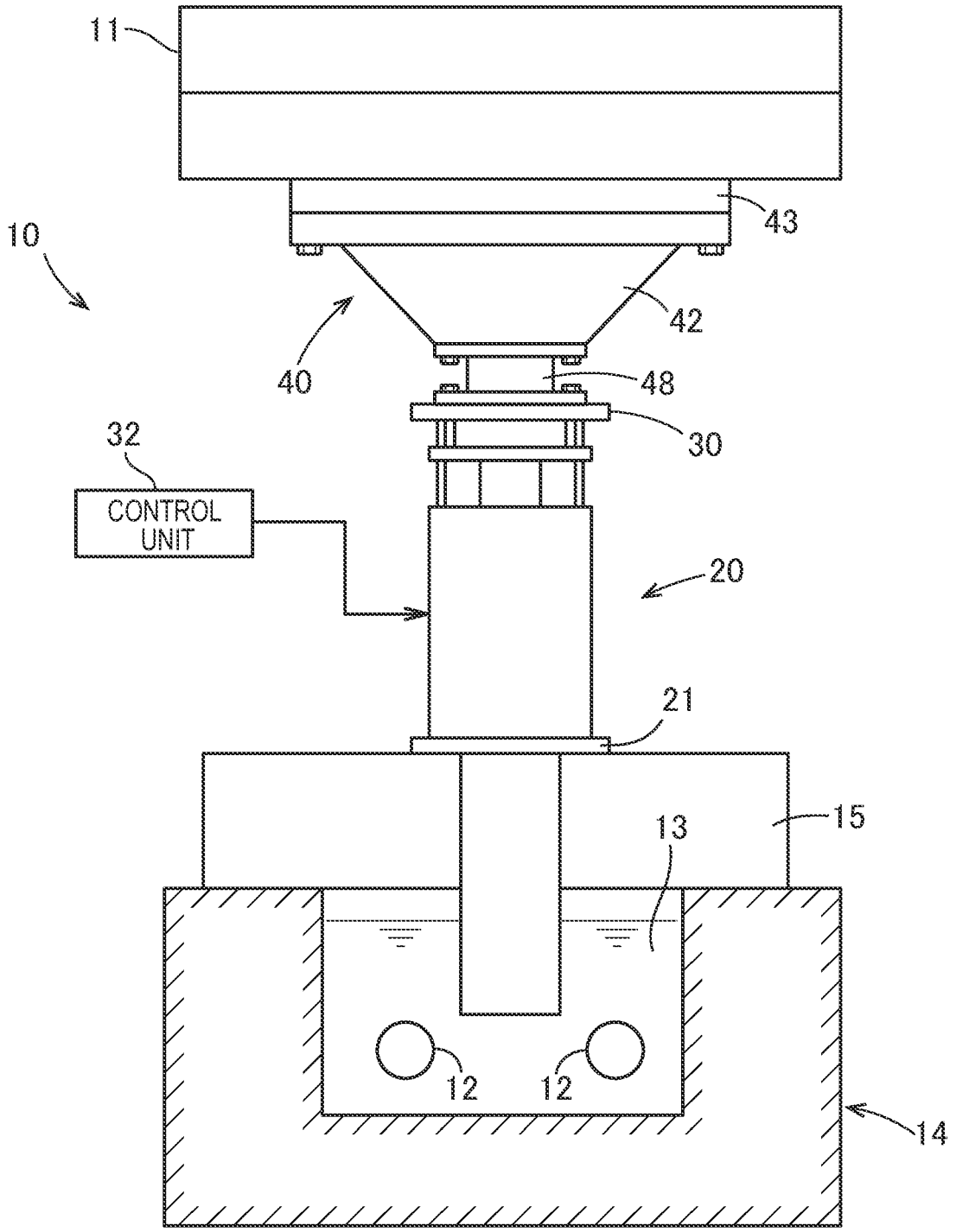
FIG. 1 is a basic structural diagram of a casting device according to the present disclosure.

As illustrated in FIG. 1, a casting device 10 includes a die 11, a molten metal flow dividing block 40, an electromagnetic pump 20, a control unit 32 that controls the electromagnetic pump 20, and a holding furnace 14 which is provided with a heater 12 and which stores therein an aluminum molten metal 13.

In this example, a steel frame 15 is mounted on the holding furnace 14, and the electromagnetic pump 20 is supported by the steel frame 15. However, how to attach the electromagnetic pump 20 to the holding furnace 14 is optional as appropriate.

Note that the holding furnace 14 is a facility that holds the temperature of the molten metal 13 at a predetermined value. The holding furnace 14 may be a melting furnace, a tapping melting furnace, or a container like a ladle that reserves aluminum in a molten state, and is not limited to a narrowly defined holding furnace.

The detailed structure of the electromagnetic pump 20 will be described with reference to FIG. 2.

Figure 2:
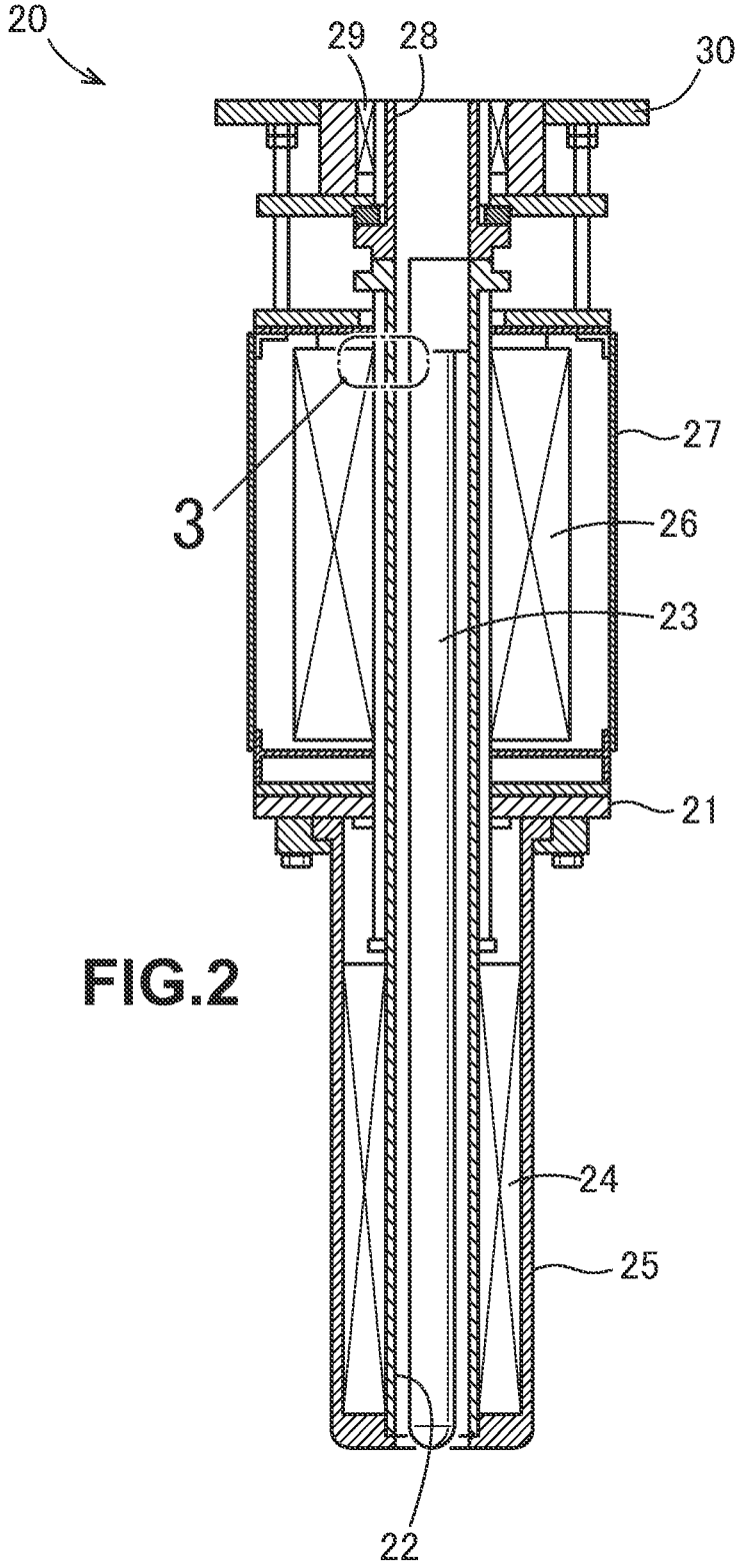
FIG. 2 is a cross-sectional view of an electromagnetic pump.

As illustrated in FIG. 2, the electromagnetic pump 20 includes a base flange 21, a molten metal guiding pipe 22 that passes completely through the base flange 21 so as to extend vertically, a core member 23 stored in the molten metal guiding pipe 22, a lower coil 24 surrounding the lower portion of the molten metal guiding pipe 22, a lower casing 25 hung by the base flange 21 so as to surround the lower coil 24, an upper coil 26 surrounding the upper portion of the molten metal guiding pipe 22, an upper casing 27 that is placed on the base flange 21 so as to surround the upper coil 26, a discharging pipe 28 that extends upwardly from the molten metal guiding pipe 22, a molten metal level gauge 29 surrounding the discharging pipe 28, and an upper flange 30 in communication with the upper casing 27.

When a current flows through the lower coil 24, the molten metal (see FIG. 1, reference numeral 13) is pulled up by the Fleming's left-hand rule.

Next, when a current flows through the upper coil 26 and no current flows through the lower coil 24, the molten metal is pulled up to the molten metal level gauge 29. This level of the molten metal level gauge 29 is a "tentative standby level".

When the current is increased, by the Fleming's left-hand rule, force increases.

When the current to the upper coil 26 is further increased, the molten metal goes over the molten metal level gauge 29, and is discharged above the discharging pipe 28. The molten metal passes through the molten metal flow dividing block 40 illustrated in FIG. 1, and is poured in the die 11.

Accordingly, the electromagnetic pump 20 is a pressure-applying molten metal pouring mechanism which pumps up the molten metal 13 stored in the holding furnace 14, and which supplies such molten metal to the die 11.

There is a pressure phenomenon peculiar to an electromagnetic action in the electromagnetic pump 20 as the pressure-applying molten metal pouring mechanism, and the inventors of the present disclosure keenly paid attention to this phenomenon. The phenomenon will be described with reference to FIG. 3.

Figure 3:
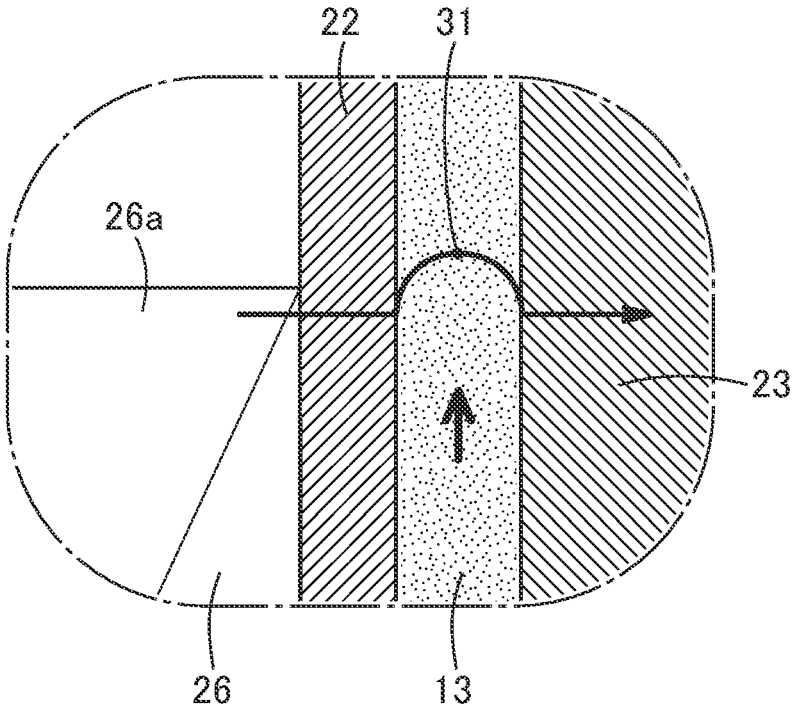
FIG. 3 is an enlarged view of a part 3 in FIG. 2.

As illustrated in FIG. 3, the molten metal 13 flows upwardly through a passage between the molten metal guiding pipe 22 and the core member 23. Magnetic fields 31 that reaches the core member 23 from an upper end 26*a* of the upper coil 26 become in a curved shape so as to project upwardly. The degree of this curving changes. That is, when the power feeding frequency is 50 Hz, the degree of the curving changes at 100 Hz that is twice.

The pressure (discharge pressure) of the molten metal 13 finely varies at a fine frequency (100 Hz) due to the change (displacement) of the magnetic fields 31. That is, inevitable fine pulsing motion occurs in the molten metal 13.

Next, the structure of the molten metal flow dividing block 40 will be described in detail with reference to FIG. 4.

Figure 4:
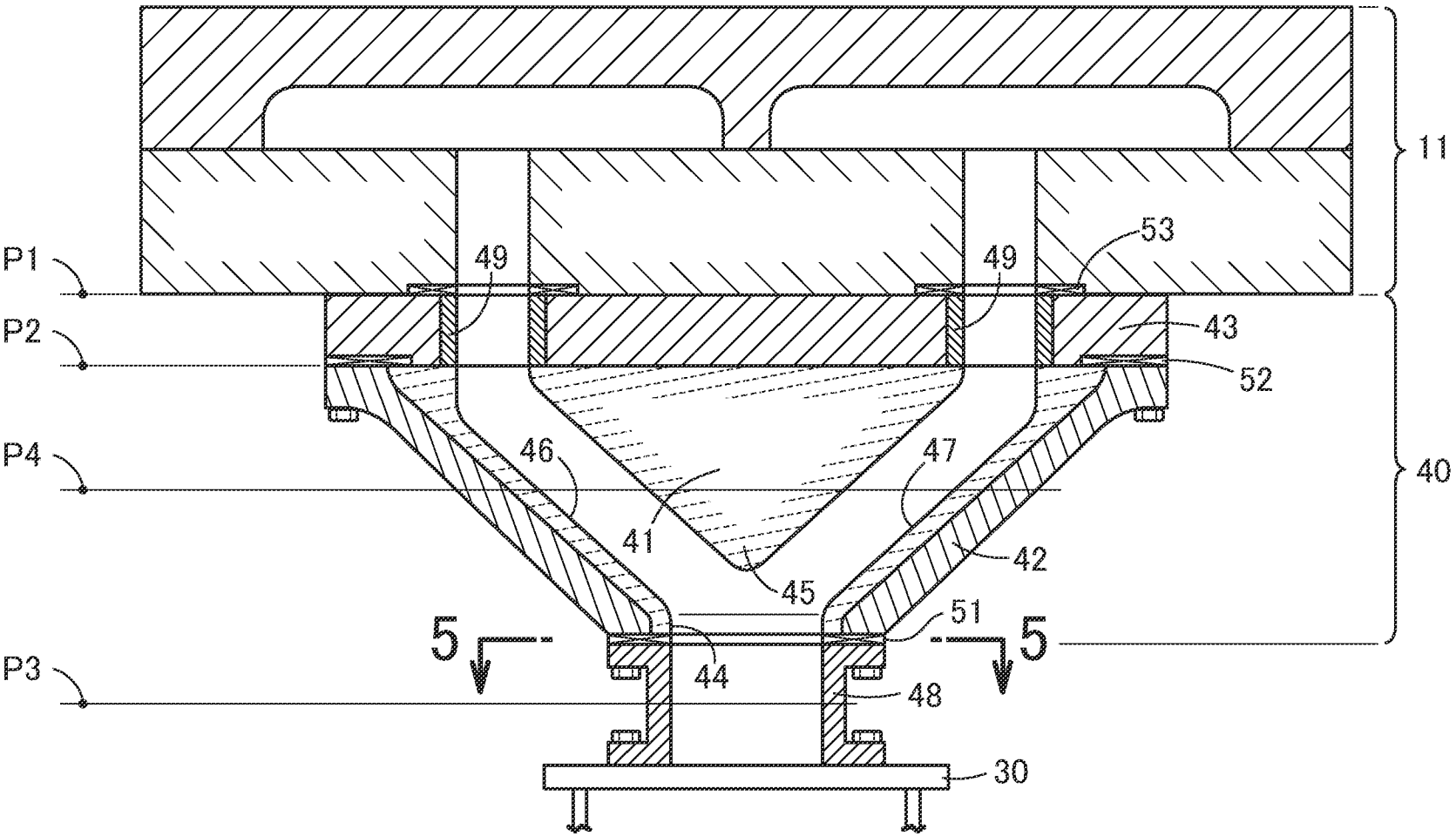
FIG. 4 is a cross-sectional view of a molten metal flow dividing block.

As illustrated in FIG. 4, the molten metal flow dividing block 40 includes ceramics 41 formed in a substantially triangular or trapezoidal cross-sectional shape, a metal casing 42 that stores therein the ceramics 41, and a metal lid 43 that closes the upper surface of the metal casing 42.

The reason why the ceramics 41 are adopted to the molten metal flow dividing block 40 will be described below.

In order to compare and examine materials, zirconia was taken as a first example, alumina was taken as a second example, and carbon steel was taken as a comparative example.

1. Basic data:

(1) First Example:

(1-1) Classification: Ceramics (1-2) Kind of Ceramics: Zirconia ($ZrO_2$)

(1-3) Thermal Conductivity X: 3 W/(M·K)

(2) Second Example:

(2-1) Classification: Ceramics (2-2) Kind of Ceramics: Alumina ($Al_2O_3$)

(2-3) Thermal Conductivity λ: 30 W/(M·K)

(3) Comparative Example:

(3-1) Classification: Metal (3-2) Kind of Metal: Carbon Steel (3-3) Thermal Conductivity λ: 43 W/(M·K)

2. Evaluation:

The smaller the thermal conductivity λ is, the smaller the temperature decrease of the molten metal becomes. In comparison with metal, ceramics has a small thermal conductivity λ which is preferable.

Among ceramics, in comparison with alumina, zirconia has a small thermal conductivity λ which is preferable.

Meanwhile, it is known that an earthenware will break if hot water is poured on the cold earthenware. Since zirconia is the same ceramics as earthenware, it has a disadvantage such that it is weak against thermal shock. Alumina also has a similarly disadvantage such that it is weak against thermal shock.

As illustrated in FIG. 4, the ceramics 41 includes one pouring gate 44, a V-shaped portion 45 protruding downwardly, and a first sprue runner 46 and a second sprue runner 47 branched by the V-shaped portion 45.

In this example, a connecting pipe 48 with an appropriate length is placed between the upper flange 30 and the pouring gate 44. However, the connecting pipe 48 may be omitted and the pouring gate 44 may be directly connected to the upper flange 30.

Moreover, the connecting pipe 48 may be integrated with the molten metal flow dividing block 40. When integrated, the V-shaped portion 45 becomes a Y-shaped portion. Hence, the V-shaped portion 45 may be a Y-shaped portion.

Moreover, the number of the branched sprue runners may be equal to or greater than three, not limited to two (the first sprue runner 46 and the second sprue runner 47).

At the outlet port of the first sprue runner 46 and at the outlet port of the second sprue runner 47, it is preferable that collars 49 each formed of ceramics should be fitted to the metal lid 43. The ceramics collars 49 improve the heat insulation performance.

A first packing 51 is placed between the connecting pipe 48 and the metal casing 42 so as to seal the dividing portion.

A second packing 52 is placed between the metal casing 42 and the metal lid 43 so as to seal the dividing portion.

A third packing 53 is placed between the metal lid 43 and the die 11 so as to seal the dividing portion.

The molten metal (see FIG. 1, reference numeral 13) flows in from the pouring gate 44, is divided by the V-shaped portion 45, passes through the first sprue runner 46 and the second sprue runner 47, and reaches the die 11.

At this time, since the V-shaped portion 45 plays a role like the bow of a ship, the molten metal flow is fairly divided, and thus no difference is caused in the flow through the first sprue runner 46 and in the flow through the second sprue runner 47.

When a plurality of (e.g., two) casted products is to be obtained by the die 11, according to the present disclosure, uniform casted products can be thus obtained.

Note that when molten metal pouring into the die 11 finishes, in order to prepare for the next casting, the molten metal is held outside the die 11. That is, in a time period between a casting and the next casting, the molten metal is sustained at the sustain position.

When a plurality of (e.g., two) casted products is to be obtained by the die 11, according to the present disclosure, uniform casted products can be thus obtained.

Note that when molten metal pouring into the die 11 finishes, in order to prepare for the next casting, the molten metal is held outside the die 11. That is, in a time period between a casting and the next casting, the molten metal is sustained at the sustain position.

As described above, the ceramics 41 are weak against thermal shock. Accordingly, devisal to be described below is adopted.

The sustain position is set substantially at a top surface P1 of the molten metal flow dividing block 40 in such a way that the molten metal flow dividing block 40 is filled with the molten metal while a repeated casting is performed. Since the molten metal flow dividing block 40 is always heated by the molten metal, there is no temperature change in the molten metal flow dividing block 40, and thus no thermal shock is applied. Consequently, the lifetime of the molten metal flow dividing block 40 is remarkably extended.

Note that the sustain position may be the level P1 that is substantially the top surface of the molten metal flow dividing block 40, or may be a level P2 that is the bottom surface of the metal lid 43. That is, it is appropriate as far as the ceramics 41 are filled by the molten metal.

Meanwhile, as described with reference to FIG. 3, when the electromagnetic pump 20 is driven by an AC power supply, a fine pressure change occurs in the molten metal. This pressure change disrupts the solidification of the molten metal. In this case, even if it is a lower temperature than that of conventional technologies, the molten metal can reach the end of the cavity of the die.

The lower the temperature of the molten metal is, the smaller the thermal shock becomes. As far as there is no possibility such that the ceramics 41 break, the sustain position of the molten metal is not limited to the level P1 or the level P2.

Hence, the sustain position of the molten metal will be discussed.

Assuming that the sustain position of the molten metal is lowered to a level P3 near the connecting pipe 48, the molten metal that moves up is divided by the V-shaped portion 45, but immediately before this molten metal flow dividing, although it is a minor phenomenon, the molten metal collides the V-shaped portion 45. This collision causes a disturbance in the molten metal flow although it is a minor phenomenon. It is desirable that there should be no disturbance although it is minor.

Accordingly, the sustain position of the molten metal is set to a level P4 above the V-shaped portion 45. This eliminates a collision. The molten metal flow without a disturbance is fairly divided by the V-shaped portion 45. Sustainment of the molten metal at the level P4 can be easily accomplished by a current control of the control unit (see FIG. 1, reference numeral 32).

Next, with reference to FIG. 5 and FIGS. 6A and 6B, the structures of the first to third packings 51, 52 and 53 will be described.

Figure 5:
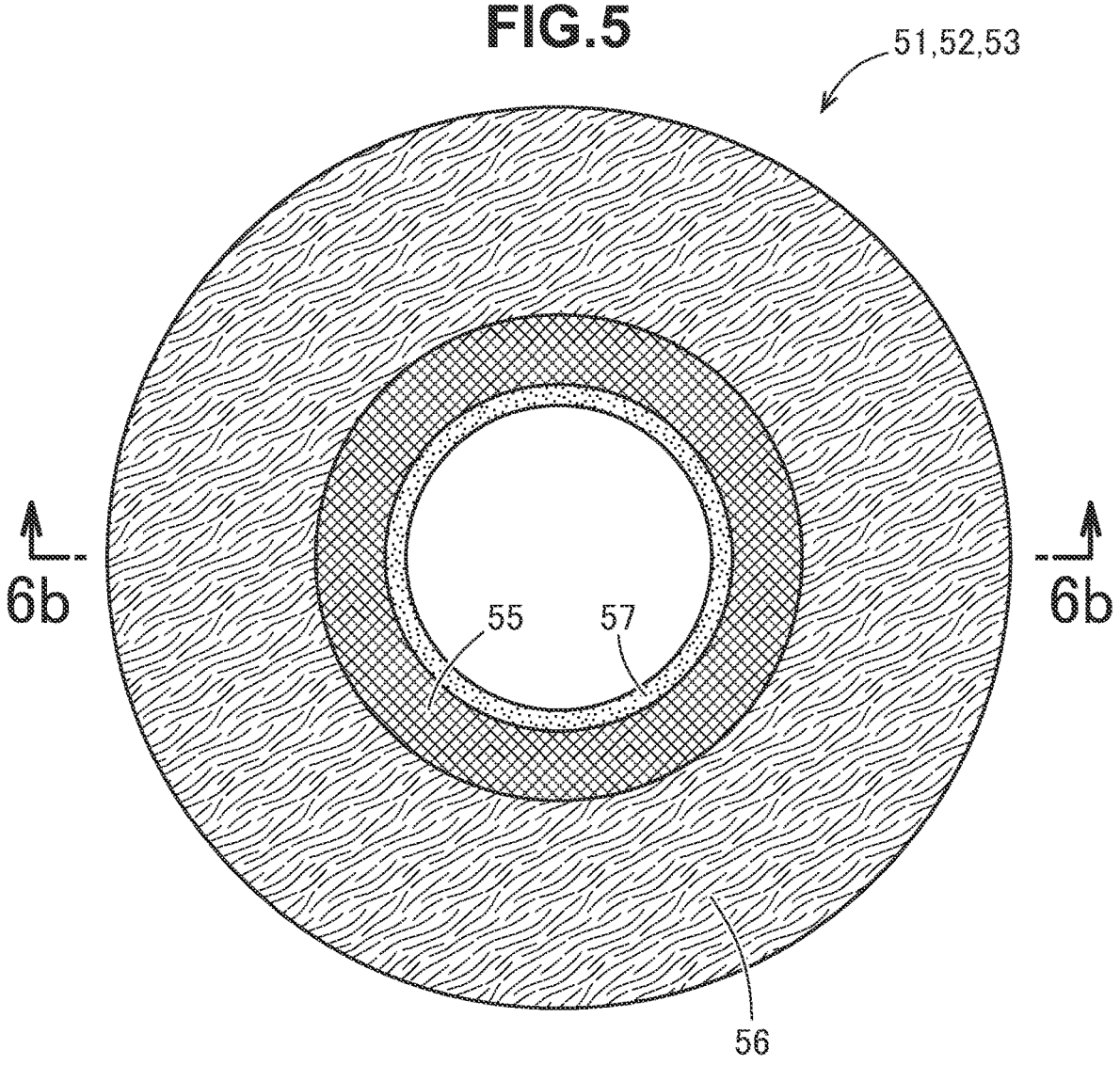
FIG. 5 is a diagram as viewed along a line 5-5 in FIG. 4.

As illustrated in FIG. 5, the first packing 51 is a composite packing that includes an inner annular portion 55 to be located near the molten metal, and an outer annular portion 56 that surrounds the inner annular portion 55 from the external side. Preferably, a ceramics-based demolding agent 57 is applied to the inner circumferential surface of the inner annular portion 55.

Figure 6A:
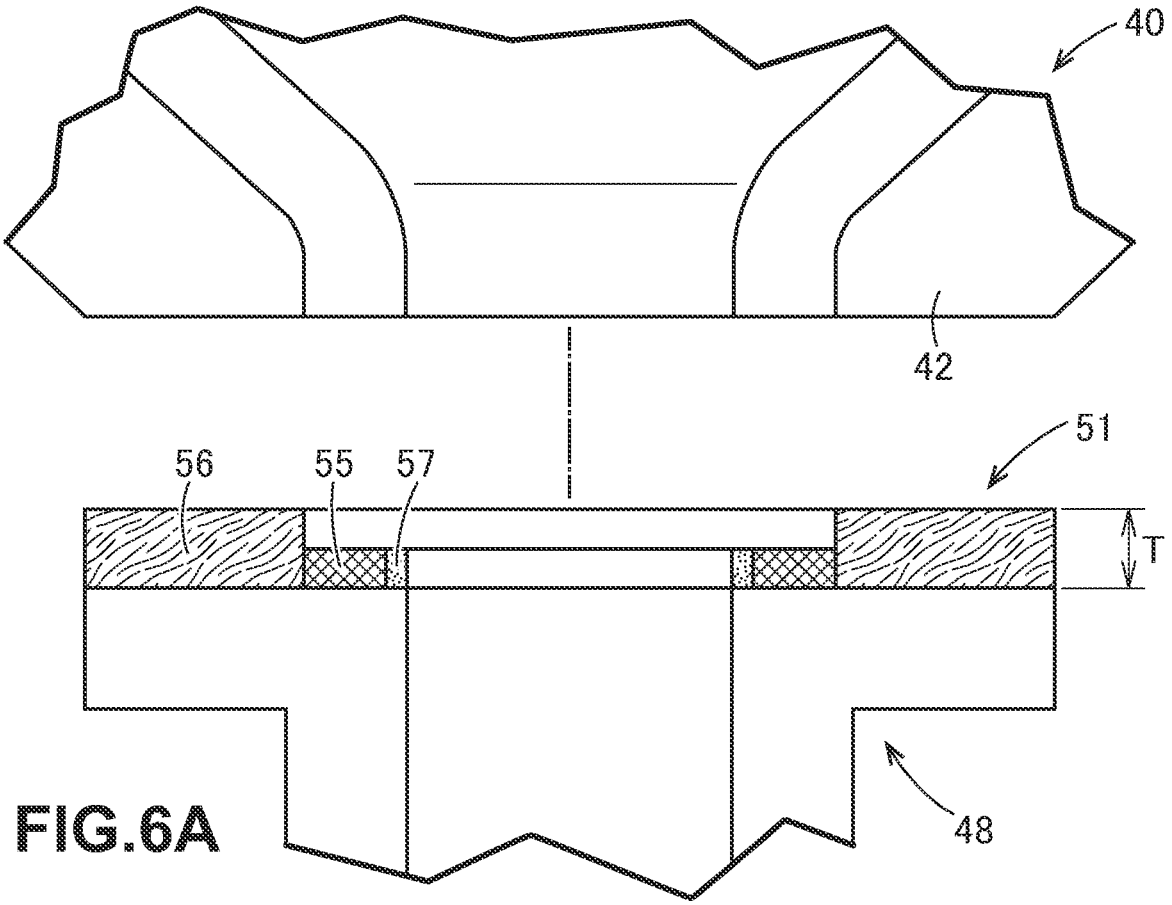
FIG. 6A is a cross-sectional view of a packing before compression.
Figure 6B:
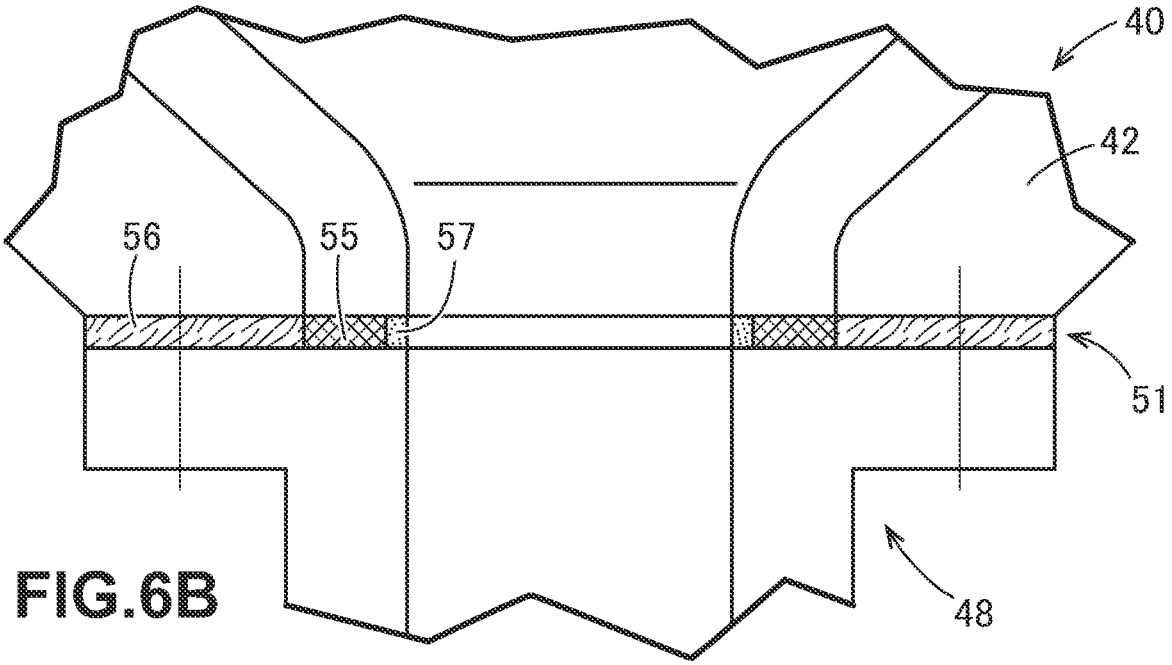
FIG. 6B is a cross-sectional view taken along a line 6*b*-6*b* in FIG. 5.
Figure 7:
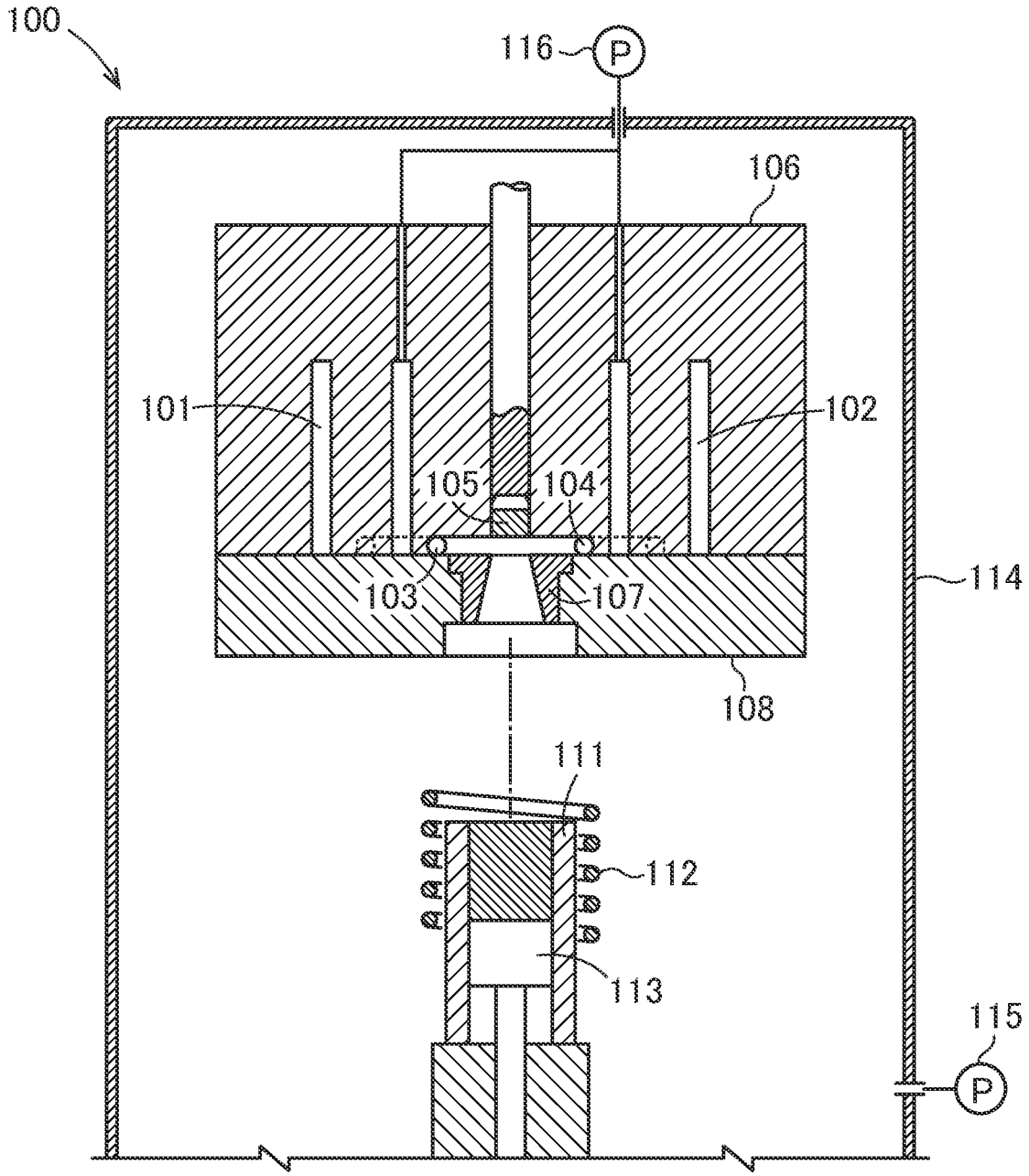
FIG.7 BACKGROUND ART
FIG. 7 is a basic structural diagram of a conventional casting device.

FIG. 6B is a cross-sectional view taken along a line 6*b*-6*b* in FIG. 5, and FIG. 6A is an exploded view of FIG. 6B.

In FIG. 6A, the outer annular portion 56 is a thin doughnut plate formed of a mass of fine ceramics.

Silica ($SiO_2$) is a kind of fine ceramics. A mineral containing silica ($SiO_2$) as a primary component is melted to obtain thin threads, and those threads are bundled to obtain such a mass. A binder is added to this mass, and the mass is processed in a tabular shape with a thickness T of substantially 4 mm, thereby obtaining a doughnut sheet.

Silica ($SiO_2$) has a heat resisting temperature that exceeds 1000° C. The mass has excellent cushioning properties. Fine ceramics may be alumina or zirconia. That is, it is appropriate if the outer annular portion 56 should be formed of a mass of fine ceramics.

The inner annular portion 55 is a woven fabric of glass long fiber (outer diameter: 10 μm). In order to enhance a processability, a heat-resisting rubber may be added to the woven fabric. As for the glass, alumina glass that has a softening point which is substantially 840° C. is appropriate.

The ceramics-based demolding agent 57 is an aluminum casting demolding agent which contains titanium oxide and vegetable oil as primary components, and to which mineral oil, poly(oxyethylene)=alkyl-ether, and black lead are added. Note that the kind of the ceramics-based demolding agent 57 is not limited to any particular kind as far as it is a demolding agent for casting.

The first packing 51 is placed between the connecting pipe 48 and the metal casing 42, and the metal casing 42 is placed so as to be relatively in proximity to the connecting pipe 48. This proximate placement causes the outer annular portion 56 to be compressed to as to be a substantially half thickness.

As illustrated in FIG. 6B, the connection portion between the connecting pipe 48 and the metal casing 42 is sealed by the first packing 51.

The molten metal is primarily intercepted by the ceramics-based demolding agent 57, and is secondarily intercepted by the inner annular portion 55. Since the inner annular portion 55 is a woven fabric, even if the molten metal contacts, it is not easily chipped (not peeled).

Consequently, the molten metal does not reach the outer annular portion 56. Since the outer annular portion 56 has excellent cushioning properties, it accomplishes a sealing performance. Accordingly, the first packing 51 suppress a leakage of the molten metal for a prolonged period.

When the second packing 52 and the third packing 53 also employ the same structure as that of the first packing 51, the leakage of the molten metal can be suppressed for a prolonged period.

Note that in the first to third packings 51 to 53, although the inner annular portion 55 and the outer annular portion 56 are essential components, the ceramics-based demolding agent 57 is not essential.

However, since the ceramics-based demolding agent 57 accomplishes the heat insulation performance of causing the heat of the molten metal to be not easily transferred to the inner annular portion 55 so as to decrease the temperature of the inner annular portion 55, and the protecting performance of easing the attack to the inner annular portion 55 by the molten metal, it is desirable that the ceramics-based demolding agent 57 should be applied to the inner circumferential surface of the inner annular portion 55.

Since the ceramics-based demolding agent 57 is most attacked by the molten metal, peeling and wear damage are remarkable. However, since the ceramics-based demolding agent 57 is applied to an exposed surface, it can be easily re-applied. Hence, by re-applying the ceramics-based demolding agent 57 appropriately or on a timely basis, the inner annular portion 55 and the outer annular portion 56 can be protected for a prolonged period.

Although the structure of the casting device 10 has been described above, a casting method that is carried out using the casting device 10 or a conventional casting device in another form will be described next.

According to this casting method, as illustrated in FIG. 4, the molten metal is sustained at the sustain position between a casting and the next casting, and in the casting, the molten metal is caused to flow from the one pouring gate 44 to the plurality of sprue runners (e.g., the first sprue runner 46 and the second sprue runner 47). The sprue runners are branched by the V-shaped portion 45, and the sustain position of the molten metal is set as the level P4 above the V-shaped portion 45. The V-shaped portion 45 is filled with the molten metal while a repeated casting is carried out.

Although the casting method can be easily carried out by the casting device 10 provided with the electromagnetic pump 20, it may be carried out by gravity die-casting or low-pressure casting.

Moreover, the molten metal may be a copper-alloy molten metal, a steel molten metal, etc., in addition to the aluminum molten metal, and the kind thereof is not limited to any particular kind.

Industrial Applicability

The present disclosure is suitable for casting that divides a molten metal flow from one pouring gate to a plurality of sprue runners.

REFERENCE SIGNS LIST

10 Casting device
11 Die
13 Molten metal
20 Electromagnetic pump
32 Control unit
40 Molten metal flow dividing block

41 Ceramics
44 Pouring gate
45 V-shaped portion
46 Sprue runner (first sprue runner)
47 Sprue runner (second sprue runner)
P1 Sustain position of molten metal (level substantially at top surface of molten metal flow dividing block)
P4 Sustain position of molten metal (level above V-shaped portion)

The invention claimed is:

1. A casting method of sustaining a molten metal at a sustain position in a casting device having one pouring gate, a downwardly protruding V-shaped portion arranged above the pouring gate and a plurality of sprue runners arranged above the V-shaped portion and branched by the V-shaped portion, wherein a molten metal flows from the pouring gate, is divided at the V-shaped portion, and passes through the plurality of sprue runners, wherein the sustain position of the molten metal is set above the V-shaped portion, and wherein the V-shaped portion is filled with the molten metal while a repeated casting is carried out.

2. A casting device comprising:

a die;

a molten metal flow dividing block;

an electromagnetic pump that supplies a molten metal; and a control unit that controls the electromagnetic pump, wherein the molten metal flow dividing block comprises one pouring gate, a downwardly protruding V-shaped portion arranged above the pouring gate, and a plurality of sprue runners arranged above the V-shaped portion and branched by the V-shaped portion formed in a V-shape, wherein the electromagnetic pump is driven by an AC power supply, and wherein the control unit is configured to drive the electromagnetic pump so as to maintain a sustain position of the molten metal above the V-shaped portion while a repeated casting is carried out.

3. The casting device according to claim 2, wherein the molten metal flow dividing block is formed of ceramics.

4. The casting device according to claim 3, wherein the control unit is configured to drive the electromagnetic pump so as to maintain the sustain position of the molten metal substantially at a top surface of the molten metal flow dividing block.

5. The casting device according to claim 2, wherein the control unit is configured to drive the electromagnetic pump so as to maintain the sustain position of the molten metal substantially at a top surface of the molten metal flow dividing block.

* * * * *